US005593525A

United States Patent [19]

Isoda et al.

[11] Patent Number: 5,593,525

[45] Date of Patent: Jan. 14, 1997

[54] PROCESS OF MAKING STRUCTURED FIBER MATERIAL

[75] Inventors: Hideo Isoda, Otsu; Tadaaki Hamaguchi; Mitsuhiro Sakuda, both of Iwakuni; Yasushi Yamada, Otsu, all of Japan

[73] Assignee: Toyo Boseki Kabushiki Kaisha, Osaka, Japan

[21] Appl. No.: 438,066

[22] Filed: May 8, 1995

Related U.S. Application Data

[62] Division of Ser. No. 169,642, Dec. 20, 1993, Pat. No. 5,462,793.

[30] Foreign Application Priority Data

Dec. 22, 1992 [JP] Japan ..... 4-342577
Apr. 23, 1993 [JP] Japan ..... 5-097838

[51] Int. Cl.[6] ..... D04H 5/00

[52] U.S. Cl. ..... 156/622; 156/624; 156/308.2; 264/116; 264/122; 264/123; 428/373

[58] Field of Search ..... 156/62.2, 62.4, 156/308.2; 264/116, 122, 123; 428/198, 298, 373

[56] References Cited

U.S. PATENT DOCUMENTS 4,621,020 11/1986 Tashiro et al. ..... 428/361
5,183,708 2/1993 Yoshida et al. ..... 428/373
5,298,321 3/1994 Isoda et al. ..... 428/288

FOREIGN PATENT DOCUMENTS 0371807 6/1990 European Pat. Off. .
0483386 5/1992 European Pat. Off. .
2307071 11/1976 France .

OTHER PUBLICATIONS

Database WPI, Section Ch, Week 8338, Derwent Pub., Ltd., Class A23, AN 83–768434, (Kuraray), JP–A–58 136 828, Aug. 15, 1983.
Database WPI, Section Ch, Week 9241, Derwent Pub., Ltd., Class A23, AN 92–336116, (Teijin), JP–A–240 219, Aug. 27, 1992.
Patent Abstracts of Japan, vol. 015, No. 504, (C–0896), Sep. 27, 1991, JP–A–32 020 354 (Unitika), Jan. 23, 1990.
Patent Abstracts of Japan, vol. 017, No. 017, (C–1016), Sep. 2, 1992, JP–A–42 045 965 (Kuraray), Jan. 28, 1991.

*Primary Examiner*—Michael W. Ball
*Assistant Examiner*—Sam Chuan Yao
*Attorney, Agent, or Firm*—Foley & Lardner

[57] ABSTRACT

There is disclosed a structured fiber material with a three-dimensional network structure containing non-elastic crimped short fibers (A) and three-dimensionally crimped composite fibers (B), the fibers (B) being partially interlocked with each other, in which contact portions the fibers (B) are partially heat-bonded with each other; the fibers (B) being partially wound around the fibers (A) at their contact points, in which contact portions the fibers (A) and (B) are partially heat-bonded with each other; and the material having an apparent density of 0.005 to 0.10 g/cm$^3$. Also disclosed is a process for producing the structured fiber material.

20 Claims, 1 Drawing Sheet

PROCESS OF MAKING STRUCTURED FIBER MATERIAL

This application is a division, of application Ser. No. 08/169,642, filed Dec. 20, 1993, which is now U.S. Pat. No. 5,462,793.

FIELD OF THE INVENTION

The present invention relates to a structured fiber material with a network structure comprising non-elastic crimped short fibers a matrix and three-dimensionally crimped elastic composite fibers containing a thermoplastic elastomer, where the composite fibers are wound around and interlocked in a coiled-spring shape with the matrix fibers, in which contact portions the composite fibers are heat-bonded with the matrix fibers. More particularly, it relates to a structured fiber material capable of being recycled, which can exhibit excellent cushioning properties, excellent resistance to plastic deformation and excellent heat-resisting durability when used as a cushioning material for household articles, beds, railway vehicles (e.g., streetcars, tramcars, trains), automobiles, etc. The present invention also relates to a process for producing the structured fiber material.

BACKGROUND OF THE INVENTION

As the cushioning material for household articles, beds, railway vehicles, automobiles, etc., usually used at the present time are urethane foam, non-elastic crimped fiber battings, and resin-bonded or hardened fabrics made of non-elastic crimped fibers.

Urethane foam, although it has excellent durability as a cushioning material, has the following disadvantages. First, urethane foam exhibits high excess compressibility and high stuffiness because it has not only poor permeability both to water vapor and to water but also regenerative properties. The addition of a halide is necessary for giving flame retardant properties to urethane foam because a great quantity of heat is evolved at the combustion, which causes a problem that poisoning may be caused by toxic gases evolved in great volume when a fire breaks out. Because the recycling of urethane foam is difficult, waste urethane foam is incinerated, in which case the incinerator is severely damaged and the removal of toxic gases costs a great deal. For this reason, waste urethane foam is mostly buffed in the ground, which causes several problems that the ground for burying may be restricted to specific places because the stabilization of a ground is difficult and that the cost of burying may be gradually raised. Further, urethane foam, although it has excellent processability, has a disadvantage that chemicals used in the production thereof may cause environmental pollution.

In the polyester fiber batting, the fibers are not fixed with each other, and therefore, the batting obtained has a problem that it may exhibit a decrease both in bulkiness and in resilience because of its shape breaking during the use, fiber movement and plastic deformation of fiber crimps.

Some examples of the resin-bonded fabric using polyester fibers bonded together with an adhesive such as a rubber-based adhesive are disclosed in JP-A 60-11352 (1985), JP-A 61-141388 (1986) and JP-A 61-141391 (1986). An example of the resin-bonded fabric using urethane is disclosed in JP-A 61-137732 (1986). These cushioning materials have disadvantages that they had poor durability, that they cannot be recycled and that complicated procedures are necessary for their processing. They also have a problem that environmental pollution may be caused by chemicals used in the production thereof.

Some examples of the hardened fabric using polyester fibers are disclosed in JP-A 58-31150 (1983), JP-A 2-154050 (1990) and JP-A 3-220354 (1991). Because the bonding-component of heat-bonding fibers used is a brittle amorphous polymer (see, e.g., JP-A 58-136828 (1983), JP-A 3-249213 (1991)), the bonded portions of the fibers are also brittle, and they can easily be broken during the use, so that the fabric changes its shape and has decreased resilience, which further brings about a decrease in durability.

As a modification, there is an interlocking treatment of constituent fibers proposed in JP-A 4-245965 (1992). Even with this treatment, the bonded portions of the fibers remain brittle and the resilience is, therefore, significantly decreased. In addition, complicated procedures are necessary for the processing of a material obtained. Further, there is a problem that the bonded portions of the fibers can hardly change their shapes and it therefore makes difficult to obtain a cushioning material having softness.

For this reason, a heat-bonding fiber using a soft polyester elastomer capable of recovering its original shape, even if given deformation, is proposed in JP-A 4-240219 (1992), and a cushioning material using this fiber is proposed in WO 91/19032 (1991). If the bonding component used in this structured fiber material is restricted to a polyester elastomer containing terephthalic acid in a proportion of 50 to 80 mol %, as an acid monomer for the hard segment and polyalkylene glycol in a proportion of 30% to 50% by weight, as a glycol monomer for the soft segment, an additional acid monomer to provide a polyester elastomer having a melting point below 180° C., which seems to be the same as the case of a fiber as disclosed in JP-B 60-1404 (1985), can be considered as isophthalic acid. The polyester elastomer therefore becomes more amorphous, and the bonded portions of the fibers can readily be formed into an amoebic shape because of its low melting viscosity. The material obtained is, however, liable to cause plastic deformation, and when it is used as a cushioning material, there is a problem that the resistance to compression at high temperatures may be decreased. Accordingly, the material cannot find any application requiring resistance to plastic deformation at high temperatures.

SUMMARY OF THE INVENTION

Under these circumstances, the present inventors have intensively studied to provide a structured fiber material capable of being recycled, which can be used as a cushioning material having excellent cushioning properties, excellent resistance to plastic deformation, excellent heat-resisting durability, little stuffiness and excellent comfortableness in the sitting thereon. As the results, they have found that such a structured fiber material can be obtained by giving three-dimensional crimps in a coiled-spring shape to stretchable composite fibers containing a thermoplastic elastomer and by winding these crimped composite fibers around matrix fibers, followed by heat-bonding to form a three-dimensional network structure, thereby completing the present invention.

Thus, the present invention provides a structured fiber material with a three-dimensional network structure comprising non-elastic crimped short fibers (A) and three-dimensionally crimped composite fibers (B), the fibers (B) being partially interlocked with each other, in which contact portions the fibers (B) are partially heat-bonded with each other; the fibers (B) being partially wound around the fibers (A) at their contact points, in which contact portions the fibers (A) and (B) are partially heat-bonded with each other; and the material having an apparent density of 0.005 to 0.10 g/cm$^3$.

The present invention also provides a process for producing a structured fiber material, comprising the steps of: (1) blending non-elastic crimped short fibers (A) and heat-bonding composite fibers (B') exhibiting no three-dimensional crimps based on their own potential crimpability, and opening these blended fibers to form three-dimensional fiber contact points between the heat-bonding composite fibers (B') as well as between the heat-bonding composite fiber (B') and the non-elastic crimped short fiber (A); (2) heat-treating these opened fibers at a temperature that is at least 10° C. higher than the melting point of a thermoplastic elastomer contained in the composite fibers (B') as a heat-bonding component, so that the potential crimpability of the heat-bonding composite fibers (B') is developed as the three-dimensional crimps, whereby at least part of the heat-bonding composite fibers (B') are wound around each other and around the non-elastic crimped short fibers (A); and (3) heat-bonding at least part of the fiber contact points to form a structured fiber material.

In a preferred embodiment, the composite fiber (B) is formed into a coiled-spring shape and is composed of a non-elastic polymer and a thermoplastic elastomer having a melting point that is at least 40° C. lower than the melting point of a polymer constituting the non-elastic crimped short fibers (A), at least part of the thermoplastic elastomer being exposed to the outer periphery in the cross-section of the composite fiber (B).

In a particularly preferred embodiment, the composite fiber (B) is formed into a coiled-spring shape and is composed of a thermoplastic elastomer (C) having a melting point that is at least 40° C. lower than the melting point of a polymer constituting the non-elastic crimped short fiber (A) and a thermoplastic elastomer (D) having a melting point that is at least 30° C. higher than the melting point of the thermoplastic elastomer (C), at least half of the thermoplastic elastomer (C) being exposed to the surface of the composite fiber (B).

DETAILED DESCRIPTION OF THE INVENTION

A structured fiber material of the present invention has a three-dimensional network structure where three-dimensionally crimped elastic composite fibers composed either of a non-elastic polymer and a thermoplastic elastomer as a heat-bonding component or of a high-melting thermoplastic elastomer and a low-melting thermoplastic elastomer are blended with non-elastic crimped short fibers as a matrix, the composite fibers being partially interlocked with each other, in which contact portions the composite fibers are partially heat-bonded with each other; the composite fibers being partially wound around the non-elastic crimped short fibers at their contact points, in which contact portions the composite fibers and the non-elastic crimped short fibers are partially heat-bonded with each other; and the heat-bonded portions of the fibers having excellent stretchability and the composite fibers in a coiled-spring shape forming the three-dimensional structure.

Figure 1:
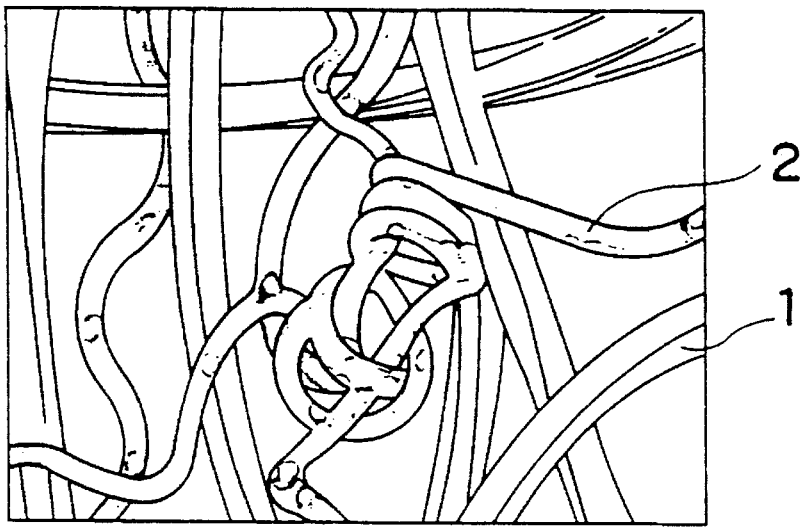
FIG. 1 is a schematic view showing non-elastic crimped short fibers and three-dimensionally crimped elastic composite fibers partially interlocked with each other.
Figure 2:
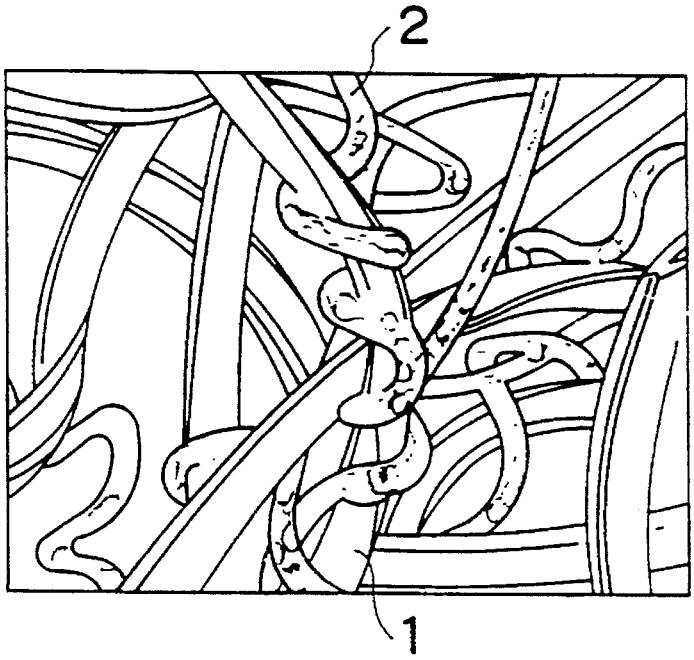
FIG. 2 is a schematic view showing three-dimensionally crimped elastic composite fibers partially wound around non-elastic crimped short fibers.

FIG. 1 shows non-elastic crimped short fibers 1 and elastic composite fibers 2 partially interlocked with each other to form a fine spiral. FIG. 2 shows elastic composite fibers 2 partially wound around non-elastic crimped short fibers 1. Because the elastic composite fibers in a coiled-spring shape are bonded with the non-elastic crimped short fibers, the structured fiber material can change its shape without breaking any bonded portion, even if given large deformation, and it can recover its original shape by the development of elastomeric stretchability, when any distortion is removed therefrom.

The structured fiber material of the present invention is materially different from the structured cushioning material disclosed in WO 91/19032 (1991), in that elastic composite fibers in a coiled-spring shape forms a three-dimensional network structure. Thus, even if the structured fiber material of the present invention is stretched to an extreme extent, the composite fibers themselves are not stretched and only their coiled-spring shapes are stretched; the bonded portions are, therefore, not broken.

In contrast, the structured cushioning material disclosed in WO 91/19032 (1991) has bonded portions that are connected without forming any coiled-crimps, so that stretching strain is raised in the constituent fibers if large deformation is given; therefore, large force is concentrated on the bonded portions and the structure is broken. Alternatively, there are some portions of the bonding component gathering in a spindle shape and some portions of only the core component remaining after the outflow of the bonding component. The latter portions are composed of a fine non-elastic fiber which has not sufficiently be hot-stretched, so that they have poor mechanical characteristics; therefore, there is a possibility that the constituent fibers may be broken by the concentration of stress.

Accordingly, the structured fiber material of the present invention has excellent resistance to plastic deformation, excellent durability and excellent cushioning properties, as compared with the structured cushioning material disclosed in WO 91/19032 (1991), in that the three-dimensional network structure contains open-winding cylindrically-coiled springs having elastomeric stretchability, which are connected with each other all over the structure.

The preferred open-winding cylindrically-coiled spiral crimps found in the structured fiber material of the present invention exhibit a reciprocal ($1/\rho$) of curvature radius ($\rho$) of their spirals in the range of from 3 to 30 mm$^{-}$, more preferably from 4 to 20 mm$^{-}$. The surface of elastic composite fibers forming preferred open-winding cylindrically-coiled spiral crimps of the present invention is covered with a thermoplastic elastomer to have insufficient fluidity, and these composite fibers are wound around and bonded with the non-elastic crimped fibers as a matrix. More preferably, the portions of the composite fibers wound around and bonded with the non-elastic crimped fibers are in slightly fluid state and the portions of the composite fibers brought into no contact with the non-elastic crimped fibers are in no fluid state. The fluid state can be determined from the diameter ratio of thick fiber portions to thin fiber portions (hereinafter referred to thick-to-thin ratio) along the fiber axis direction. For example, the elastic composite fibers disclosed in WO 91/19032 (1991) have spindle-shaped joint portions and have a thick-to-thin ratio of about 1.7, and it can be said that composite fibers having no such spindle shaped joint portions have insufficient fluidity. The thick-to-thin ratio of fiber diameters along the fiber axis direction in the portions other than the bonded portions of the preferred elastic composite fibers of the present invention is 1.2 or less, and there exist no spindle-shaped joint portions. More preferably, the thick-to-thin ratio is 1.1 or less, and there exist no spindle-shaped joint portions.

Another structured fiber material of the present invention has a three-dimensional network structure where elastic composite fibers composed of a thermoplastic elastomer as a heat-bonding component and a thermoplastic elastomer as a support of the network structure in the matrix of non-elastic crimped short fibers are partially interlocked with each other or with the non-elastic crimped short fibers at their contact points while exhibiting their own potential crimpability, in which contact portions both fibers are partially heat-bonded with each other to give bonded points having excellent stretchability, most of the portions other than the bonded points being composed of a stretchable thermoplastic elastomer having three-dimensionally-coiled crimps.

Because the non-elastic crimped short fibers as a matrix are connected on the bonded points having excellent stretchability to form a three-dimensional network structure, the structured fiber material of the present invention can change its shape without breaking any bonded points or three-dimensional network structure, even if large deformation is given, and it can recover its original shape by the development of elastomeric stretchability, when any distortion is removed therefrom.

In the structured fiber material of the present invention, the elastic composite fibers form a three-dimensional network structure, so that even if the structured fiber material is stretched to an extreme extent, the three-dimensional network structure of the elastic composite fibers having excellent stretchability is stretched as a whole, but the non-elastic crimped fibers themselves are not stretched; therefore, the bonded portions are also not broken.

In contrast, the structured cushioning material disclosed in WO 91/19032 (1991) has bonded points which are connected in line with each other through non-elastomer fibers, so that stretching strain is raised in the constituent fibers if large deformation is given; large force is, therefore, concentrated on the bonded points and the structure is broken. Alternatively, there are some portions of the bonding component gathering in a spindle shape and some portions of only the core component remaining after the outflow of the bonding component. The latter portions are composed of a fine non-elastic fiber which has not sufficiently be hot-stretched, so that they have poor mechanical characteristics; therefore, there is a possibility that the constituent fibers may be broken by the concentration of stress.

Accordingly, the structured fiber material of the present invention has excellent resistance to plastic deformation, excellent durability and excellent cushioning properties, as compared with the structured cushioning material disclosed in WO 91/19032 (1991), in that all the portions of the material are connected through the elastic composite fibers having elastomeric stretchability to form a three-dimensional network structure.

The structured fiber material of the present invention has an apparent density of 0.005 to 0.1 g/cm$^3$. When the apparent density is higher than 0.1 g/cm$^3$, the fiber density is increased to excess, so that the constituent thermoplastic elastomers weld together very easily in a tight fashion and the structured fiber material has significantly reduced resilience in the thickness direction and also reduced breathability to become stuffy very easily, which is not suitable for use as a cushioning material. When the apparent density is lower than 0.005 g/cm$^3$, the number of non-elastic crimped short fibers serving as a matrix is decreased, so that the repulsion force of the structured fiber material as a cushioning material is lost, which is not preferred. In this regard, the structured fiber material of the present invention is quite different from the two-dimensionally structured dense material having an improved reinforcing effect and flexibility, such as tapes, ribbons and sheets, as disclosed in JP-A 58-197312 (1983).

The content of elastic composite fibers forming a three-dimensional network structure having stretchability and/or having a coiled-spring shape in the structured fiber material of the present invention is preferably in the range of from 10% to 70% by weight, more preferably from 20% to 50% by weight, based on the total weight of the material. When the content is less than 5% by weight, the three-dimensional structure is formed to a decreased extent, so that the structured fiber material has poor resistance to plastic deformation, poor durability and poor cushioning properties, which is not preferred. When the content is more than 70% by weight, the bulkiness based on the rigidity of the non-elastic crimped fibers is fairly decreased. In general, cushioning materials should be repulsive upon compression in the thickness direction, and therefore, for the purpose of attaining such an effect, it is preferred that the structured fiber material of the present invention has a thickness of at least 5 mm, more preferably at least 10 mm.

The non-elastic crimped short fibers as a matrix constituting the structured fiber material of the present invention are not particularly limited, so long as they can be recycled with the use of a thermoplastic polymer. Taking into consideration mechanical properties, heat-resisting properties and toxic gas evolution at the combustion, preferred are polyester fibers such as crimped short fibers obtained by spinning, stretching and crimping of a polymer selected from polyethylene terephthalate (PET), polyethylene naphthalate (PEN), polycyclohexylenedimethylene terephthalate (PCHDT), polybutylene terephthalate (PBT), polyarylate, and copolymer polyesters thereof; or crimped short fibers obtained by giving potential crimpability in the composite spinning of a combination of two polymers having different thermal properties selected from the above-described polymers or in the asymmetric cooling method, followed by stretching, and if necessary, by giving mechanical crimps and/or by developing three-dimensional crimps.

The fineness, cross-sectional shape and mechanical properties of these polyester crimped short fibers can be determined depending on the desired application, but the fineness is usually 3 to 500 denier, preferably 4 to 200 denier. It is preferred that the cross-sectional shape has a hollow profile, particularly hollow profile having different cross-sections such as polygons or palmated-leaf shapes. In particular, it is preferred to use non-elastic crimped short fibers having high modulus even after the formation into a structured fiber material (in which case their crimps have increased resistance to plastic deformation caused by distortion at room temperature or under heat conditions); for example, in case of PET, it is particularly preferred to use non-elastic crimped short fibers having an initial tensile strength of at least 30 denier, more preferably at least 40 g/denier, and having a cross-sectional shape with large moment of inertia of area or a circular cross-sectional area ratio of at least 1.3, more preferably at least 1.5, because their resistance to compression and resistance to plastic deformation at high temperatures can be improved.

It is also particularly preferred to use non-elastic crimped short fibers having three-dimensional crimps or a crimping degree of at least 20%, more preferably at least 25%, because their resistance to plastic deformation at high temperatures and cushioning properties can be improved. This is because non-elastic crimped short fibers having three-dimensional crimps with resistance to plastic deformation at high temperatures and resistance to compression and elastic composite fibers having stretchability are heat-bonded together to form a three-dimensional network structure having stretchability as a whole, so that even if large force is exerted in any direction or large deformation is given, individual elastic composite fibers make a slight change in their shapes to absorb the force or distortion all over the network structure, thereby attaining a significant reduction of damage to the non-elastic crimped fibers as a matrix, which gives an improvement in the resistance to plastic deformation at high temperatures and cushioning properties.

The elastic composite fibers (B) in a coiled-spring shape, which form a three-dimensional network structure of the structured fiber material of the present invention, are composed of a thermoplastic elastomer and a non-elastic polymer. The thermoplastic elastomer as a heat-bonding component may preferably have a melting point of at least 40° C., particularly at least 60° C., lower than the melting point of a polymer constituting the non-elastic crimped short fibers. When the melting point difference therebetween is less than 40° C., because the heat-treatment temperature at the heat bonding process is preferably set to be at least 10° C., more preferably 20° to 80° C., higher than the melting point of the thermoplastic elastomer, the heat-treatment temperature is too high for the non-elastic crimped short fibers, so that plastic deformation or deterioration of physical properties will be caused on the crimps of the non-elastic crimped short fibers, resulting in a structured fiber material having poor characteristics.

The melting point of the thermoplastic elastomer is preferably in the range of from 140° C. to 220° C. Further, the thermoplastic elastomer as a heat-bonding component is partially exposed to the outer periphery in the cross-section of the composite fibers and occupies at least half, preferably all, of the fiber surface; therefore, heat bonding can be achieved in all the contact portions and the coiled network portions are covered with a thermoplastic elastomer having excellent stretch recovery properties, so that all the transformed coiled portions can recover their original shapes. For this reason, the elastic composite fibers in the structured fiber material contain a thermoplastic elastomer kept having poor fluidity on the surface. The weight ratio of thermoplastic elastomer to non-elastic polymer in the elastic composite fibers is preferably in the range of from 20/80 to 70/30.

Alternatively, the elastic composite fibers forming a three-dimensional network structure having excellent stretchability in the structured fiber material of the present invention is composed of a thermoplastic elastomer as a heat-bonding component and a thermoplastic elastomer as a support of the three-dimensional network structure. The thermoplastic elastomer as a heat-bonding component preferably has a melting point of at least 40° C., particularly at least 60° C., lower than the melting point of a polymer constituting the non-elastic crimped short fibers. When the melting point difference therebetween is less than 40° C., because the heat-treatment temperature at the heat bonding process is preferably set to be at least 10° C., more preferably 20° to 80° C., higher than the melting point of the thermoplastic elastomer, the heat-treatment temperature is too high for the non-elastic crimped short fibers, so that plastic deformation or deterioration of physical properties will be caused on the crimps of the non-elastic crimped short fibers, resulting in a structured fiber material having poor characteristics. If the contact points are formed by heat treatment at a temperature higher than the melting point of the thermoplastic elastomer forming the three-dimensional network structure, the melting of the elastic composite fibers will be cause, which makes it impossible to form the three-dimensional network structure. (For this reason, the thermoplastic elastomer as a support of the three dimensional network structure has a melting point that is at least 30° C., preferably 40° C., higher than the melting point of the thermoplastic elastomer as a heat-bonding component.) Therefore, the thermoplastic elastomer as a heat-bonding component may preferably has a melting point of 140° to 190° C.

Further, if the thermoplastic elastomer as a heat-bonding component does not occupy at least half of the fiber surface, the number of bonded points will be decreased, resulting in a three-dimensional network structure having ineffective stretchability. It is preferred that all the fiber surface is occupied by the heat-bonding component because heat bonding can be achieved at all the contact points and a three-dimensional network structure having effective stretchability can be formed. Also, when the content of a soft segment in the stretchable component is decreased to achieve the condition that the thermoplastic elastomer as a support of the three-dimensional network structure should have a melting point that is at least 30° C., preferably 40° C., higher than the melting point of the thermoplastic elastomer as a heat-bonding component, the three-dimensional network structure is covered with a thermoplastic elastomer having excellent stretch recovery properties as a heat-bonding component, so that the transformed three-dimensional network structure can recover its original structure.

In such a case, it is preferred that the elastic composite fibers in the structured fiber material contain a thermoplastic elastomer kept having fairly poor fluidity on the surface. The weight ratio of thermoplastic elastomer as a heat-bonding component to thermoplastic elastomer as a support of the three-dimensional network structure in the elastic composite fibers is preferably in the range of from 20/80 to 70/30. The elastic composite fibers may have a side-by-side structure capable of readily developing three-dimensional crimps, but they have an eccentric sheath-core structure or a sheath-core structure with the side-by-side core, both capable of readily developing three-dimensional crimps is preferred from the above-described reason. More preferred is a hollow sheath-core structure capable of improving flexural rigidity because a cushioning material having increased resilience can be obtained.

The composition of the thermoplastic elastomer is not particularly limited, so long as it is within a certain range causing no practical problems. It is preferred that thermoplastic polymers or copolymers with high crystallinity are used for hard segments and block copolymers of a polyether or polyester having a relatively high molecular weight are used for soft segments because the elastic composite fibers forming the heat-bonding portions and the three-dimensional network structure have excellent stretchability and excellent heat resistance, resulting in a structured fiber material having improved resistances both to heat and to plastic deformation. More preferably, when the non-elastic crimped fibers are selected from polyester fibers, the thermoplastic elastomer is also selected from polyesters having excellent bonding properties therewith.

Examples of the polyester elastomer are polyester-ether block copolymers having a thermoplastic polyester as a hard segment and polyalkylenediol as a soft segment; and polyester-ester block copolymers having a thermoplastic polyester as a hard segment and an aliphatic polyester as a soft segment.

Typical examples of the polyester-ether block copolymer are block terpolymers composed of at least one dicarboxylic acid selected from aromatic dicarboxylic acids such as terephthalic acid, isophthalic acid, naphthalene-2,6-dicarboxylic acid, naphthalene-2,7-dicarboxylic acid and diphenyl-4,4'-dicarboxylic acid, alicyclic dicarboxylic acids such as 1,4-cyclohexanedicarboxylic acid, aliphatic dicarboxylic acids such as succinic acid, adipic acid and dimerized sebacic acid, and ester-forming derivatives thereof; at least one diol monomer selected from aliphatic diols such as 1,4-butanediol, ethylene glycol, trimethylene glycol, tetramethylene glycol, pentamethylene glycol and hexamethylene glycol, alicyclic diols such as 1,1-cyclohexanedimethanol and 1,4-cyclohexane-dimethanol, and ester-forming derivatives; and at least one selected from polyalkylene-diols such as polyethylene glycol, polypropylene glycol, polytetramethylene glycol and ethylene oxide-propylene oxide copolymers, each having an average molecular weight of about 300 to 5000.

Examples of the polyester-ester block copolymer are block tercopolymers composed of a dicarboxylic acid and a diol monomer, both selected from the above respective groups, as well as at least one selected from aliphatic polyesters such as polylactones having an average molecular weight of about 300 to 3000. Taking into consideration the heat-bonding properties, resistance to hydrolysis, stretchability and heat resistance, particularly preferred is a block tercopolymer composed of a terephthalic acid or naphthalene-2,6-dicarboxylic acid as the dicarboxylic acid, 1,4-butanediol as the diol monomer and polytetramethylene glycol as the polyalkylenediol. When necessary, copolymerization can be carded out with a silicone polymer as the soft segment to give high resistance to hydrolysis.

The polyester constituting the hard segment with more excellent crystallinity is difficult to cause plastic deformation and has improved resistance to plastic deformation at high temperatures. If crystallization treatment is carried out after the melt-thermo-forming step, the resistance to plastic deformation at high temperatures is still more improved. Although the reason for this is unknown, an endothermic peak in the melting curve is more clearly observed by a differential scanning calorimeter (DSC) at a temperature below the melting point of the polyester, when terephthalic acid and/or naphthalene-2,6-dicarboxylic acid are contained in high contents. pseudo-crystalline cross-linked points are formed to improve the resistance to plastic deformation at high temperatures. The amount of terephthalic acid and/or naphthalene-2,6-dicarboxylic acid as an acid monomer is preferably in the range of 90 to 100 mol %, more preferably 100 mol %. When the amount of terephthalic acid and/or naphthalene-2,6-dicarboxylic acid is less than 90 mol %, the thermoplastic elastomers obtained has low crystallinity, so that it causes plastic deformation and has poor resistance to plastic deformation at high temperatures. Also, even if crystallization treatment is carried out after the melt-thermoforming step, it is difficult to obtain a thermoplastic elastomer having improved resistance to plastic deformation at high temperatures.

The thermoplastic elastomer of the composite fibers in the structured fiber material of the present invention preferably contains 1,4-butanediol and polytetramethylene glycol as copolymerizable glycol monomers, the polytetramethylene glycol being preferably contained in a proportion of at least 10% by weight, more preferably 30% to 80% by weight, based on the total weight of the thermoplastic elastomer. The recovery properties based on rubber elasticity depend on the proportion of polytetramethylene glycol. The melting point is decreased and the heat resistance is deteriorated. When the proportion of polytetramethylene glycol is less than 5% by weight, the recovery properties based on rubber elasticity are significantly deteriorated. When the proportion is 80% by weight, the resulting thermoplastic elastomer has a decreased melting point, thereby causing the deterioration of heat resistance, and it also exhibits the development of tackiness, thereby making it difficult to perform uniform dispersing and opening of the elastic composite fibers. The proportion of polytetramethylene glycol in the heat-bonding component is preferably in the range of from 40% to 70% by weight, more preferably from 50% to 60% by weight, based on the total weight of the heat-bonding component. To maintain the heat resistance, when the repeating unit of a hard segment is made large, the average molecular weight of polytetramethylene glycol should also be made large to maintain the recovery properties based on rubber elasticity. However, too high molecular weights bring the loss of compatibility, thereby delaying the proceeding of polymerization, and it is, therefore, necessary to select an appropriate range of the average molecular weight for the polytetramethylene glycol. The average molecular weight is preferably in the range of from 500 to 5000, particularly preferably from 1000 to 3000. When the average molecular weight is more than 5000, the characteristics at low temperatures are significantly deteriorated, which is not preferred.

In contrast, the component as a support of the three-dimensional structure should have a melting point higher than that of the heat-bonding component and a function of keeping its shape, as well as appropriate stretchability, and it is, therefore, preferred that the repeating unit of a hard segment is made large and polytetramethylene glycol having a higher average molecular weight of at least 300 in view of solubility to maintain the recovery properties based on rubber elasticity. The proportion of polytetramethylene glycol is preferably in the range of from 5% to 50% by weight, more preferably from 10% to 40% by weight, based on the total weight of the support component.

With respect to the molecular weight of a preferred polyester-ether copolymer of the present invention, the heat-bonding component containing a soft segment in high contents has a relative viscosity ($\eta_{sp/c}$) of at least 1.8 as measured in a phenol/tetrachloroethane mixed solvent at 40° C. When the relative viscosity is lower than 1.8, although the fluidity becomes good to improve the bonded point forming properties, the recovery properties of bonded points are deteriorated and the connect points in the three-dimensional network structure formed by the elastic composite fibers exhibit increased plastic deformation, resulting in a structured fiber material having poor resistance to plastic deformation and poor durability, which is not preferred. More preferably, the heat-bonding component has a relative viscosity of 2.0 to 2.5. When the viscosity is higher than 2.5, the fluidity of the heat-bonding component is fairly decreased in the heat-bonding step below 200° C., which may cause insufficient formation of bonded points.

In contrast, the component as a support of the three-dimensional network structure has a fairly low relative viscosity because it contains a soft segment in low contents. The relative viscosity of the support component is preferably at least 1.0, more preferably at least 1.5, which gives recovery properties and toughness to the support.

In a more preferred embodiment of the present invention, the heat-bonding component of the elastic composite fibers contains polytetramethylene glycol in high proportions, thermal stability is deteriorated at high temperatures above 250° C. because a significant molecular weight loss is caused by thermal decomposition. For this reason, in the present invention, the thermoplastic elastomer is preferably allowed to contain an antioxidant in an amount of at least 1% by weight, more preferably 2% to 5% by weight, based on the total weight of the thermoplastic elastomer. Such a composition makes it possible to carry out the spinning at high temperatures and to use a hard segment having high crystallinity and a high melting point, for example, hard segment having a large repeating unit using an acid monomer such as terephthalate or naphthalate and a glycol monomer such as ethylene glycol, butanediol or cyclohexylenedimethanol, in the support component of the three-dimensional structure, thereby attaining the resistance to plastic deformation at high temperatures of the three-dimensional network structure comprising stretchable coiled-fibers formed by the elastic composite fibers.

Further, it is possible to carry out the heat melt-bonding step in air at a temperature above 200° C. by the use of a thermoplastic elastomer having a high melting point and a high molecular weight, at which time a molecular weight loss of the heat-bonding component can be prevented. Thus, the structured fiber material of the present invention has improved resistance to plastic deformation at high temperatures and also has significantly improved recovery properties based on rubber elasticity because the molecular weight of the thermoplastic elastomer can be kept at a high level.

Preferred examples of the antioxidant which can be used in the present invention are conventional hindered phenol compounds and conventional hindered amine compounds. Particularly preferred are hindered phenol compounds exhibiting no evolution of any toxic gas at the combustion. The preferred polyester-ether block copolymer used in the structured fiber material of the present invention can be obtained by a conventional method, for example, as disclosed in JP-A 55-120626 (1980). In this method, an antioxidant is preferably kneaded with the heat-bonding component under pressure after the polymerization because the sublimation of antioxidant added in large amounts during the polymerization makes a trouble such as clogging of a polymerization kettle and the effects of antioxidant added are significantly deteriorated.

Examples of the non-elastic polyester constituting the preferred elastic composite fibers of the present invention are polyesters with high crystallinity, such as polyethylene terephthalate (PET), polybutylene terephthalate (PBT), polyethylene naphthalate (PEN) and polycyclohexylene dimethylene terephthalate (PCHDT). Particularly preferred are PBT and PET. The polyesters with higher crystallinity are preferred because crystallization treatment can be performed on these polyesters to a sufficient extent in the processing step so that they become difficult to cause plastic deformation, thereby making it possible to attain excellent durability and resilience of the three-dimensional network structure. It is particularly preferred that the elastic composite fibers having a coiled-spring shape are uniformly dispersed in the matrix of non-elastic crimped short fibers to form a three-dimensional network structure all over the matrix because the structured fiber material having uniform cushioning properties can be obtained.

The uniform dispersion of the elastic composite fibers in the matrix of the non-elastic crimped short fibers can be achieved as follows. The elastic composite fibers forming the bonded points with excellent stretchability and constituting the three-dimensional network structure can be obtained as elastic composite fibers given their own potential crimpability by spinning and stretching them into a structure such as a side-by-side structure, an eccentric sheath-core structure and a sheath-core structure with the side-by-side core. In particular, elastomers have stickiness and elastomer fibers have high frictional properties, so that the opening with a card readily becomes inferior. For this reason, the elastic composite fibers are preferably given mechanical crimps that can readily be opened. The mechanical opening can be employed, so long as the number of crimps is in the range of from 5 to 30 crests/inch and the degree of crimping is in the range of from 5% to 30%, and the number of crimps is preferably in the range of from 10 to 25 crests/inch and the degree of crimping is preferably in the range of from 10% to 25%. It is particularly preferred to use a finishing oil agent capable of reducing the friction coefficient of the fibers.

Thus, it is not preferred that the elastic composite fibers are allowed to develop their own potential crimpability to prepare three-dimensional crimped fibers with low shrinkage as disclosed in JP-A 4-240219 (1992) because the development of three-dimensional crimps at the thermoforming step makes it difficult to achieve the winding of the elastic composite fibers around the matrix fibers and the winding of the elastic composite fibers around each other, thereby making impossible to form a three-dimensional network structure having stretchability. The preferred elastic composite fibers giving a more preferred structured fiber material of the present invention can be obtained by stretching spun fibers at a ratio of 0.8 to 0.9 in a water bath at a temperature of 40° to 70° C.; giving mechanical crimps the stretched fibers; and supplying the crimped fibers to a cutter with a tension not extending the mechanical crimps for cutting. With respect to the preferred potential crimpability of the elastic composite fibers of the present invention, the reciprocal ($1/\rho$) of curvature radius of coiled crimps after the free treatment with dry heat at 130° C. is at least 3 $mm^{-1}$, preferably 5 $mm^{-1}$, and more preferably 10 $mm^{-1}$. When the reciprocal is less than 2 $mm^{-1}$, the winding of the elastic composite fibers does not sufficiently occur, and it is necessary to form the bonded points into an amoebic shape by raising the temperature in the heat-bonding step. Then, opening and blending are carried out with a conventional card, and the web thus obtained has three-dimensional fiber contact points between the elastic composite fibers and between the elastic composite fiber and the non-elastic crimped short fiber. An appropriate number of such webs are laminated and compressed, followed by heat treatment with hot air, hot inert gas or superheated steam to develop the potential crimpability of the elastic composite fibers for the formation of three-dimensional coiled-crimps, at which time the winding of the elastic composite fibers around the matrix fibers is achieved. Then, this laminate is heated at a temperature that is at least 10° C. higher than the melting point of the thermoplastic elastomer as a heat-bonding component, by which at least part of fiber contact points are heat-bonded, followed by cooling, resulting in a three-dimensional network structure having stretchability. To obtain a more preferred structured fiber material of the present invention, it is preferred that the structured fiber material thus obtained is further subjected to pseudo-crystallization treatment at a temperature that is at least 20° C. lower than the melting point of the thermoplastic polyester-ether copolymer as a heat-bonding component because the recovery properties are improved for the above reasons. The heat treatment with about 10% compressive strain is more preferred because the recovery properties are still more improved.

The structured fiber material of the present invention thus obtained provides a cushioning material capable of being recycled, which has excellent durability, excellent resistances both to heat and to plastic deformation, excellent cushioning properties and little stuffiness in the sitting thereon, all of which are close to the characteristics of urethane foam that seem to have not been attained by any conventional fiber cushioning material.

The present invention will be further illustrated by way of the following examples and comparative examples, which are not to be construed to limit the scope thereof.

EXAMPLES 1–8 AND COMPARATIVE EXAMPLES 1–14

(1) Preparation of Heat-Bonding Component

Dimethyl terephthalate (DMT) and/or dimethyl isophthalate (DMI) or naphthalene-2,6-dicarboxylic acid (DMN) as an acid monomer(s), and 1,4-butanediol (BD) and polytetramethylene glycol (PTMG) as glycol monomers were placed, together with small amounts of catalyst and stabilizer, in a reaction vessel, and the mixture was subjected to ester exchange reaction in the conventional method, followed by polycondensation with increasing the temperature and reducing the pressure, which afforded a polyester-ether block copolymer elastomer.

The polyester-ether block copolymer elastomer thus obtained was pelletized, followed by vacuum drying under heating, to which an anti-oxidant (Ionox 330, Ciba-Geigy Ltd.) was added in an amount of not greater than 3% by weight, if necessary. The mixture was melt and kneaded with a twin-screw extruder, and then pelletized again, followed by drying with a heated dry inert gas for sufficient removal of water. The pellets thus obtained were used for the heat-bonding component.

For comparison, low-melting non-elastic polyesters were prepared in the same manner as described above, except that ethylene glycol (EG) was used as the glycol monomer in place of 1,4-butanediol (BD) and polytetramethylene glycol (PTMG).

The formulation and characteristic properties of various polyester-ether block copolymers and low-melting non-elastic polyesters obtained above are shown in Table 1. The measurements of relative viscosity was conducted with an Ostwald viscometer in a bath controlled at 30° C. The sample polymer was pulverized and dissolved in a mixture of phenol and tetrachloroethane (60/40) at 80° C., and the resulting solution was subjected to the measurements. The relative viscosity ($\eta_{sp/c}$) was determined by the following equation:

$$\eta_{sp/c}=(t/t_0-1)/c$$

where t is a time for dropping a sample solution, $t_0$ is a time for dropping only the mixed solvent, and c corresponds to the weight of the sample solution in 100 cc volume. An average of two measurements was taken.

TABLE 1

| | Run No. | | | | | | | | | | | | |
|---|---|---|---|---|---|---|---|---|---|---|---|---|---|
| | A-1 | A-2 | A-3 | A-4 | A-5 | A-6 | A-7 | A-8 | A-9 | A-10 | A-11 | A-12 | A-13 |
| Acid monomer | | | | | | | | | | | | | |
| Kind | DMT | DMT | DMT/DMI | DMT/DMI | DMT/DMI | DMT | DMT/DMI | DMT | DMT | DMN | DMT | DMN | DMT/DMI |
| Amount (parts) | 645 | 645 | 580/65 | 516/129 | 634/634 | 645 | 647/162 | 946 | 1014 | 1075 | 1222 | 1144 | 634/634 |
| PTMG | | | | | | | | | | | | | |
| M.W. | 2000 | 2000 | 2000 | 2000 | — | 2000 | 1000 | 1000 | 1000 | 1000 | 1000 | 1000 | — |
| Amount (parts) | 1328 | 1328 | 1328 | 1328 | 0 | 1328 | 928 | 698 | 581 | 553 | 225 | 441 | 0 |
| Anti-oxidant Amount (wt %) | 0.05 | 3.0 | 3.0 | 0.05 | 0.05 | 3.0 | 3.0 | 3.0 | 3.0 | 3.0 | 3.0 | 3.0 | 0.05 |
| Properties | | | | | | | | | | | | | |
| $\eta_{sp/c}$ | 2.4 | 2.4 | 2.2 | 2.1 | 0.7 | 2.4 | 1.8 | 2.1 | 2.0 | 1.9 | 1.8 | 1.9 | 0.7 |
| m.p. (°C.) | 177 | 179 | 174 | 152 | 110 | 179 | 172 | 200 | 205 | 227 | 220 | 236 | 110 |
| Additional glycol monomer | BD | BD | BD | BD | EG | BD | BD | BD | BD | BD | BD | BD | EG |

(2) Preparation of Heat-Bonding Fiber

(i) Heat-Bonding Fibers B-1 to B-8

A polyester elastomer selected from the polyester-ether block copolymers and the low-melting non-elastic polyesters was used as a sheath component, and polyethylene terephthalate (PET) was used as a core component. These components in a sheath/core weight ratio of 50/50 were subjected to spinning at a temperature of 280° to 295° C. so as to be eccentric in the conventional method, which afforded an unstretched fiber. The eccentricity, (L+R)/R, where L is the distance from the fiber center to the core center and R is the radius of the fiber, was set to be 1.15, or 1 for comparison. Then, the unstretched fiber was stretched at a ratio of 3.4 in a water bath at 50° C. followed by coating with a finishing oil agent. The stretched fiber was given mechanical crimps with a crimper. The crimped fiber was supplied to a cutter with a tension not extending the mechanical crimps, and cut into a length of 51 mm, which afforded head-bonding composite short fibers each having a fineness of 4 denier.

For comparison, heat-bonding composite short fibers were prepared in the same manner as described above, except that the heat treatment was carried out at 80° C. to develop three-dimensional crimps.

The characteristic properties of the heat-bonding fibers thus obtained are shown in Table 2. The relative viscosity of the polyester-ether block copolymer or low-melting non-elastic polyester in the fiber was determined as a relative viscosity that was corrected with the relative viscosity of the fiber obtained by the addition of PET to each component under the same spinning conditions as those employed for PET, and with the composition ratio of the fiber, supposing that additivity will be established on the solution viscosity. The amount of anti-oxidant contained in the fiber was determined as follows: the anti-oxidant contained in the fiber was extracted with a solvent, the extract was purified by the removal of impurities, followed by the quantitative analysis with the amount of antioxidant added being used as a comparative blank, and the measurements were corrected with the composition ratio. The degree of crimping and the number of crimps were measured by the method of JIS-L-1074. The potential crimpability (1/ρ) is expressed as a reciprocal of the curvature radius of the developed spiral.

(ii) Heat-Bonding Fibers C-1 to C-9

A low-melting thermoplastic elastomer selected from the polyester-ether block copolymers and the low-melting non-elastic polyesters was used as a sheath component, and a high-melting thermoplastic elastomer selected from the polyester-ether block copolymers was used as a core component. As a comparison, polybutylene terephthalate (PBT) or polyethylene terephthalate (PET) was used as a core component. These components in a sheath/core weight ratio of 50/50 were subjected to spinning at a temperature of 260° to 285° C. so as to be eccentric in the conventional method, which afforded an unstretched fiber. The eccentricity, (L+R)/R, where L is the distance from the fiber center to the core center and R is the radius of the fiber, was set to be 1.15, or 1 for comparison. Then, the unstretched fiber was stretched at a draw ratio of 3.4 in a water bath at 50° C., followed by coating with a finishing oil agent. The stretched fiber was given mechanical crimps with a crimper. The crimped fiber was supplied to a cutter with a tension not extending the mechanical crimps, and cut into a length of 51 mm, which afforded head-bonding composite short fibers each having a fineness of 4 denier.

For comparison, heat-bonding composite short fibers were prepared in the same manner as described above, except that the heat treatment was carried out with dry heat at 60° C. to develop three-dimensional crimps.

The characteristic properties of the heat-bonding fibers thus obtained are shown in Table 3. The strength and the elongation were measured by the method of JIS-L-1074. The other properties were determined as described above.

TABLE 2

| | Run No. | | | | | | | |
|---|---|---|---|---|---|---|---|---|
| | B-1 | B-2 | B-3 | B-4 | B-5 | B-6 | B-7 | B-8 |
| Heat-bonding component | A-1 | A-1 | A-1 | A-2 | A-3 | A-4 | A-4 | A-5 |
| Non-bonding component | PET | PET | PET | PET | PET | PET | PET | PET |
| Spinning temperature (°C.) | 280 | 280 | 290 | 280 | 280 | 280 | 290 | 290 |
| Crimps | mechanical | mechanical | three-dimensional | mechanical | mechanical | mechanical | three-dimensional | mechanical |
| Degree of crimping (%) | 12 | 13 | 18 | 15 | 12 | 10 | 17 | 12 |
| Number of crimps (crests/inch) | 26 | 26 | 20 | 22 | 27 | 30 | 20 | 19 |
| l/ρ ($mm^{-1}$) | 8.2 | 0 | 3.9 | 10.3 | 8.6 | 7.7 | 2.4 | 6.1 |
| Anti-oxidant (wt %) | unmeasurable | unmeasurable | unmeasurable | 2.8 | 2.7 | unmeasurable | unmeasurable | unmeasurable |
| $\eta_{sp/c}$ | 2.0 | 2.0 | 1.7 | 2.3 | 2.1 | 1.8 | 1.6 | 0.62 |
| Eccentricity (L + R)/R | 1.15 | 1.0 | 1.15 | 1.15 | 1.15 | 1.15 | 1.15 | 1.15 |

TABLE 3

| | Run No. | | | | | | | | |
|---|---|---|---|---|---|---|---|---|---|
| | C-1 | C-2 | C-3 | C-4 | C-5 | C-6 | C-7 | C-8 | C-9 |
| Heat-bonding component | A-6 | A-6 | A-7 | A-7 | A-8 | A-9 | A-13 | A-7 | A-7 |
| Non-bonding component | A-10 | A-11 | PBT | A-6 | A-12 | A-12 | PET | A-11 | A-11 |
| Spinning temperature (°C.) | 260 | 260 | 260 | 260 | 270 | 270 | 285 | 260 | 260 |
| Crimps | mechanical | mechanical | mechanical | mechanical | mechanical | mechanical | mechanical | mechanical | three-dimensional |
| Strength (g/d) | 1.6 | 1.8 | 2.4 | 1.2 | 1.9 | 1.9 | 3.3 | 1.7 | 1.4 |
| Elongation (%) | 86 | 82 | 63 | 181 | 76 | 75 | 51 | 78 | 82 |
| $1/\rho$ ($mm^{-1}$) | 8.6 | 7.0 | 8.0 | 2.5 | 8.3 | 4.2 | 6.4 | 0.0 | 3.4 |
| Degree of crimping (%) | 16 | 18 | 15 | 11 | 18 | 18 | 18 | 16 | 15 |
| Number of crimps (crests/inch) | 16 | 17 | 18 | 22 | 18 | 17 | 15 | 15 | 16 |
| $\eta_{sp/c}$ of sheath component | 2.3 | 2.3 | 1.7 | 1.7 | 2.0 | 1.9 | 0.6 | 1.7 | 1.7 |

(3) Preparation of Structured Fiber Material

The heat-bonding composite short fiber having mechanical crimps and PET short fiber having three-dimensional crimps were blended at a ratio of 30/70 and opened with a card, which afforded a web. The PET short fiber used herein was prepared to have a fineness of 13 denier in the conventional method, and it was a hollow fiber having three projections on the outer periphery in the cross-section. The web obtained above was compressed to have a density of 0.03 g/cm$^3$, and then heat-treated with hot air at 150° to 210° C. for 5 minutes to form a plate-shaped cushioning material. After cooling, the cushioning material was compressed to have a density of 0.04 g/cm$^3$, and then heat-treated with hot air at 100° C. for 30 minutes, followed by cooling, which afforded a cushioning material.

For comparison, cushioning materials were prepared in the same manner as described above, except that the web was compressed to have a density of 0.004 or 0.12 g/cm$^3$ and additional heat-treatment was not carded out.

The conditions of cushioning material preparation and the finishing conditions of the cushioning materials, such as winding around short fibers, heat-bonding with short fibers, interspersion of heat-bonded contact points and development of coiled-crimps which were observed by scanning electron microscopy, are shown in Tables 4 and 5, and the other characteristic properties of the cushioning materials are shown in Tables 6 and 7. The opening properties was determined by the working characteristics of fibers, i.e., fiber passing characteristics through a card used.

The characteristic properties were determined by the following methods.

(1) Apparent Density

A sample material is cut into a square piece of 10 cm×10 cm in size. The volume of this piece is calculated from the thickness measured at four points. The division of the wight by the volume gives the apparent density (an average of three measurements is taken).

(2) Heat-Resisting Durability (permanent set after compression at 70° C.)

A sample material is cut into a square piece of 15 cm×15 cm in size. This piece is 50% compressed, followed by standing under heat dry at 70° C. for 22 hours to remove compression strain. The permanent set after compression at 70° C. is determined as the percentage ratio (%) of its thickness after standing overnight to its original thickness before the compression (an average of three measurements is taken).

(3) Permanent Set after Repeated Compression

A sample material is cut into a square piece of 15 cm×15 cm in size. This piece is repeatedly compressed to 50% thickness with Servo-Pulser (Shimadzu Corp.) at a cycle of 1 Hz in a room at 25° C. under a relative humidity of 65%. After repeatedly compressing 20,000 times, the permanent set after repeated compression is determined as the percentage ratio (%) of its thickness after standing overnight and its original thickness before the compression (an average of three measurements is taken).

(4) Hardness at 25% Compression

A sample material is cut into a square piece of 20 cm×20 cm in size. This piece is compressed to 65% thickness with a disc of 150 mmϕ using a tensilon (Toyo Baldwin Co., Ltd.) to give a stress-strain curve. The hardness at 25% compression is determined as a compressive force at 25% compression in the stress-strain curve (an average of three measurements is taken).

(5) Impact Resilience

Impact resilience is measured by the method as described in Reference 2 of JIS K-6401 (1980).

(6) Comfortableness etc.

Ten monitors are allowed to sit on a sample cushioning material placed on the floor in a room at 30° C. under a relative humidity of 75% for 1 hour, and the sample is evaluated sensuously by these monitors for excess compressibility (the degree of feeling as if they sat directly on the floor with a bump), comfortableness (the period of time within 8 hours, for which they can sit on the cushioning material) and stuffiness (the degree of stuffy feeling on their hips or in the inside of their thighs after the sitting for 2 hours). The cushioning material on which the monitors cannot sit for 1 hour because of a pain on their hips or thighs is rated as poor.

TABLE 4

| | Ex. 1 | Comp. Ex. 1 | Comp. Ex. 2 | Ex. 2 | Ex. 3 | Ex. 4 | Comp. Ex. 3 | Comp. Ex. 4 | Comp. Ex. 5 | Comp. Ex. 6 | Comp. Ex. 7 |
|---|---|---|---|---|---|---|---|---|---|---|---|
| Composite fiber | B-1 | B-2 | B-3 | B-4 | B-5 | B-6 | B-7 | B-8 | B-1 | B-1 | B-1 |
| Opening | ○ | ○ | X | ○ | ○ | ○ | X | ○ | ○ | ○ | ○ |
| Fusing treatment at (°C.) | 200 | 200 | 200 | 200 | 200 | 200 | 210 | 200 | 200 | 200 | 150 |
| Density after fusing treatment ($g/cm^3$) | 0.030 | 0.030 | 0.030 | 0.030 | 0.030 | 0.030 | 0.030 | 0.030 | 0.120 | 0.004 | 0.030 |
| Additional heat treatment | done | none | done | done | done | done | none | none | none | none | none |
| Final apparent density ($g/cm^3$) | 0.032 | 0.030 | 0.036 | 0.031 | 0.033 | 0.036 | 0.030 | 0.030 | 0.120 | 0.004 | 0.026 |
| Winding around short fiber | good | none | none | good | good | fair | none | poor | none | good | good |
| Bonding with short fiber | good | good | good | good | good | fair | poor | poor | good | good | unbonded |
| Interspersion of heat-bonded contact points | excellent | excellent | poor | excellent | excellent | excellent | poor | excellent | unknown | good | excellent |

TABLE 5

| | Ex. 5 | Ex. 6 | Comp. Ex. 8 | Comp. Ex. 9 | Ex. 7 | Ex. 8 | Comp. Ex. 10 | Comp. Ex. 11 | Comp. Ex. 12 | Comp. Ex. 13 | Comp. Ex. 14 |
|---|---|---|---|---|---|---|---|---|---|---|---|
| Composite fiber | C-1 | C-2 | C-3 | C-4 | C-5 | C-6 | C-7 | C-8 | C-9 | C-1 | C-1 |
| Opening | ○ | ○ | ○ | ○ | ○ | ○ | ○ | ○ | Δ | ○ | ○ |
| Fusing treatment at (°C.) | 200 | 200 | 200 | 200 | 200 | 210 | 210 | 150 | 200 | 200 | 210 |
| Density after fusing treatment ($g/cm^3$) | 0.030 | 0.030 | 0.04 | 0.04 | 0.030 | 0.03 | 0.04 | 0.04 | 0.04 | 0.004 | 0.120 |
| Additional heat treatment | done | done | none | none | done | done | none | none | none | none | none |
| Final apparent density ($g/cm^3$) | 0.032 | 0.033 | 0.04 | 0.04 | 0.034 | 0.034 | 0.04 | 0.04 | 0.04 | 0.004 | 0.120 |
| Development of coiled-crimps | good | good | good | none | good | good | poor | none | poor | good | poor |
| Winding around short fiber | good | good | good | poor | good | good | poor | none | poor | good | good |
| Interspersion of heat-bonded contact points | excellent | excellent | excellent | excellent | excellent | excellent | excellent | excellent | fairly poor | excellent | unknown |

TABLE 6

| | Ex. 1 | Comp. Ex. 1 | Comp. Ex. 2 | Ex. 2 | Ex. 3 | Ex. 4 | Comp. Ex. 3 | Comp. Ex. 4 | Comp. Ex. 5 | Comp. Ex. 6 | Comp. Ex. 7 |
|---|---|---|---|---|---|---|---|---|---|---|---|
| Permanent set after compression at 70° C. (%) | 21 | 28 | 30 | 16 | 26 | 28 | 35 | 45 | 38 | 20 | 28 |
| Permanent set after repeated compression | 5 | 11 | 12 | 3 | 4 | 8 | 14 | 16 | — | 8 | 10 |

TABLE 6-continued

| | Ex. 1 | Comp. Ex. 1 | Comp. Ex. 2 | Ex. 2 | Ex. 3 | Ex. 4 | Comp. Ex. 3 | Comp. Ex. 4 | Comp. Ex. 5 | Comp. Ex. 6 | Comp. Ex. 7 |
|---|---|---|---|---|---|---|---|---|---|---|---|
| (%) | | | | | | | | | | | |
| Impact resilience (%) | 72 | 61 | 51 | 78 | 70 | 63 | 45 | 52 | 56 | 21 | 50 |
| Hardness at 25% compression (kg) | 16 | 12 | 10 | 18 | 17 | 15 | 11 | 26 | — | 0.1 | 8 |
| Excess compressibility | none | low | moderate | none | none | low | moderate | low | high | high | moderate |
| Comfortableness | excellent | fairly good | fairly poor | excellent | excellent | excellent | fairly poor | poor | poor | poor | fairly poor |
| Stuffiness | low | low | low | low | low | low | low | low | high | high | low |

TABLE 7

| | Ex. 5 | Ex. 6 | Comp. Ex. 8 | Comp. Ex. 9 | Ex. 7 | Ex. 8 | Comp. Ex. 10 | Comp. Ex. 11 | Comp. Ex. 12 | Comp. Ex. 13 | Comp. Ex. 14 | Reference urethane |
|---|---|---|---|---|---|---|---|---|---|---|---|---|
| Permanent set after compression at 70° C. (%) | 15 | 12 | 35 | 30 | 23 | 25 | 46 | 32 | 33 | 28 | 36 | 15 |
| Permanent set after repeated compression (%) | 4 | 3 | 16 | 13 | 5 | 8 | 25 | 10 | 9 | 8 | — | 5 |
| Impact resilience (%) | 68 | 57 | 49 | 48 | 61 | 52 | 58 | 48 | 50 | 32 | 65 | 82 |
| Hardness at 25% compression (kg) | 14 | 12 | 18 | 13 | 14 | 15 | 19 | 15 | 14 | 2 | — | 12 |
| Excess compressibility | none | none | low | low | none | none | moderate | low | low | high | high | low |
| Comfortableness | excellent | excellent | good | good | excellent | good | poor | good | good | poor | poor | fairly poor |
| Stuffiness | low | low | low | low | low | low | low | low | low | high | high | high |

The structured fiber materials of Examples 1 and 2 had excellent cushioning properties, excellent resistance to plastic deformation at high temperatures and excellent resistance to plastic deformation even at room temperature because of their three-dimensional network structure containing elastic composite fibers in a coiled-spring shape wound around and heat-bonded with the non-elastic crimped short fibers as a matrix. Further, these materials were evaluated as cushioning materials exhibiting little excess compressibility, little stuffiness and excellent comfortableness in the sitting thereon for a long time.

In particular, the structured fiber material of Example 2, which is the most preferred embodiment of the present invention, exhibited heat-resisting durability and resistance to plastic deformation, both of which are close to those of urethane foam, and it was, therefore, evaluated as a very comfortable cushioning material.

In Comparative Example 1, the elastic composite fibers have the same composition as the cases of Examples 1 and 2, but their crimps were not developed with good interspersion of heat-bonded contact points. Because the elastic composite fibers were not wound around the non-elastic crimped short fibers as a matrix, the thermoplastic elastomer had insufficient fluidity, so that the maintenance of bonded points became poor and resistance to plastic deformation at room temperature was particularly deteriorated.

The structured fiber material of Comparative Example 2 exhibited poor interspersion of the elastic composite fibers, as compared with the material of Comparative Example 1. Although pseudo-cross-linked points were formed by additional heat treatment of the thermoplastic elastomer, the material of Comparative Example 2 was evaluated as an uncomfortable cushioning material exhibiting a decrease all in the heat-resisting durability, resistance to plastic deformation at room temperature and resilience.

In Examples 3 and 4, the thermoplastic elastomer was made amorphous to cause plastic deformation. The structured fiber materials of these examples had slightly decreased resistance to plastic deformation, as compared with the cases of Examples 1 and 2, but they were also evaluated as cushioning materials exhibiting excellent cushioning properties, excellent resistance to plastic deformation at high temperatures, excellent resistance to plastic deformation at room temperature, little excess compressibility, little stuffiness and excellent comfortableness in the sitting thereon for a long time.

In Comparative Example 3, the thermoplastic elastomer had the same composition as the case of Example 4, but the elastic composite fibers were not wound around the non-elastic crimped short fibers as a matrix and the thermoplastic elastomer was allowed to have satisfactory fluidity. Although the bonded points were sufficiently formed into an amoebic shape and spindle-shaped joints were also formed, the structured fiber material of Comparative Example 3 was evaluated as an uncomfortable cushioning material exhibiting a deterioration both of the heat-resisting durability and of the resistance to plastic deformation, and it was unsuited to sit thereon for a long time.

In Comparative Example 4, the elastic composite fibers had a similar shape to that of Example 4, but the heat-bonding component was made of a non-elastic polymer. Because the bonding component was brittle and liable to cause plastic deformation, the material of this comparative example had poor resistance to heat and deteriorated resistance to plastic deformation at room temperature. Further, this material had no stretchability and felt hard, although it exhibited little excess compressibility; the monitors had a pain on their hips and thighs by oppression and the material was evaluated as an uncomfortable cushioning material difficult to sit thereon for a long time.

Comparative Example 5 was the case where the material had a high density out of the claimed range. The most part of the material was composed of a polymer mass, and a large compressive force to break the mass was necessary for 50% compression. It was, therefore, evaluated to measure the permanent set after repeated compression and the hardness at 25% compression because these measurements were beyond the capability of measuring equipment. Of course, the material of this comparative example exhibited the poorest comfortableness in the sitting thereon as if the monitors sat on a hard polymer base.

Comparative Example 6 was the case where the material had a low density out of the claimed range. When a constant strain is given to the material, the stress applied to the respective fibers is significantly reduced because of high bulkiness. Therefore, the resistance to plastic deformation at 50% strain was not deteriorated, but the material obtained was too soft for use as a cushioning material.

Comparative Example 7 was the case where the material having the same structure and composition was prepared in the same manner as the case of the present invention, except that the contact points of elastic composite fibers with non-elastic crimped short fibers were not heat-bonded. Because the contact points having a coiled spring shape in the three-dimensional network structure were not fixed, the material obtained was soft, and its heat-resisting durability and resistance to plastic deformation were both deteriorated. Therefore, it was evaluated as a cushioning material having fairly poor comfortableness in the sitting thereon.

The structured fiber material of Examples 5 to 8 had a stretchable three-dimensional network structure that was composed of elastic composite fibers, so that they exhibited excellent cushioning properties, excellent resistance to plastic deformation at high temperatures and excellent resistance to plastic deformation even at room temperature. Further, these materials had little excess compressibility and little stuffiness, and they were evaluated as cushioning materials having comfortableness in the sitting thereon for a long time. In particular, the structured fiber material of Example 6 that is the most preferred embodiment of the present invention exhibited excellent heat-resisting durability and excellent resistance to plastic deformation, both of which are close to those of urethane foam, and it was evaluated as a cushioning material having excellent comfort ableness in the sitting thereon.

Comparative Example 8 was the case where the elastic composite fibers used were composed of a conventional elastomer as the sheath component and a non-elastic polyester as the core component. The conventional elastomer was prepared to contain an amorphous segment by the use of a copolymerizable monomer for the purpose of decreasing its melting point. The bonded points were satisfactorily formed into an amoebic shape and the spindle-shaped joints were also formed. However, the elastomer was liable to cause plastic deformation, and the core portion was covered with no elastomer component, so that the bonded points in the three-dimensional network structure were connected together through the non-elastic polymer. Therefore, the material of this comparative example had poor resistance to plastic deformation at high temperatures, poor durability at room temperature and poor impact resilience, and it was evaluated as a cushioning material having deteriorated characteristics.

In Comparative Example 9, a difference in melting point between the non-bonding component and the heat-bonding component was so small that the non-bonding component also melted and the three-dimensional network structure was not formed. Therefore, the material of this comparative example had poor resistance to plastic deformation at high temperatures, poor durability at room temperature and poor impact resilience, and it was evaluated as a cushioning material having deteriorated characteristics.

Comparative Example 10 was the case where the material had the same structure as the case of the present invention, except that the heat-bonding component was made of a non-elastic polymer. Because the bonding component was brittle and liable to cause plastic deformation, the material of this comparative example had particularly poor resistance to heat and deteriorated resistance to plastic deformation at room temperature. Further, this material had no stretchability and felt hard, although it exhibited little excess compressibility; the monitors had a pain on their hips and thighs by oppression and the material was evaluated as an uncomfortable cushioning material difficult to sit thereon for a long time.

The material of Comparative Example 11 had no three-dimensional structure having contact points in a coiled-spring shape, which resulted in a fair deterioration of its resistance to plastic deformation at high temperatures and resilience.

Comparative Example 12 was the case where elastic composite fibers with their potential crimpability being developed were used and there was no interlocking of the fibers. The material of this comparative example had fairly deteriorated resistance to plastic deformation at high temperatures and resilience, similarly to the case of Comparative Example 11.

Comparative Example 13 was the case where the material had a low density out of the claimed range. When a constant strain is given to the material, the stress applied to the respective fibers is significantly reduced because of high bulkiness. Therefore, the resistance to plastic deformation at 50% strain was not deteriorated, but the material obtained was too soft for use as a cushioning material.

Comparative Example 14 was the case where the material had a high density out of the claimed range. The most part of the material was composed of a polymer mass, and a large compressive force to break the mass was necessary for 50% compression. It was, therefore, difficult to measure the permanent set after repeated compression and the hardness at 25% compression because these measurements were beyond the capability of measuring equipment. Of course, the material of this comparative example exhibited the poorest comfortableness in the sitting thereon as if the monitors sat on a hard polymer base.

The structured fiber materials of Examples 1 to 6 were tested for flame retardant properties in the 45° methenamine method and the 45° alcohol lamp method. As the result, both structured fiber materials of Examples 1 and 2 passed. As a comparison, polyurethane foam was tested in the same methods, and it was found to fail in the test. Further, the toxic index of a combustion gas from these materials was determined by the procedures of JIS K-7217. As the result, the toxic index was 5.1 for all the structured materials of Examples 1 to 6, and 7.5 for polyurethane foam, indicating that the structured fiber materials of the present invention have high safety.

The structured fiber material of the present invention has a three-dimensional network structure where elastic composite fibers containing a thermoplastic elastomer are wound around non-elastic crimped short fibers as a matrix, in which contact portions both fibers are heat-bonded with each other though the thermoplastic elastomer to form high-stretchable bonded points in a coiled-spring shape that are uniformly interspersed all over the structure. Therefore, the material has excellent cushioning properties, excellent heat-resisting durability and excellent resistance to plastic deformation, and it is suitable for use as a cushioning material having little stuffiness during the use, no excess compressibility and excellent comfortableness in the sitting thereon. In particular, a structured fiber material that is the most preferred embodiment of the present invention exhibits excellent heat-resisting durability and excellent resistance to plastic deformation, both of which are close to those of urethane foam, and it is most suitable for use as a cushioning material because of its more comfortableness and higher safety as compared with urethane foam. Because the elastic composite fiber is a fiber material made of a thermoplastic polymer, the elastic composite fiber once used can be recycled as a fiber material by opening and reforming, which is quite effective for the preservation of global environment. The structured fiber material of the present invention can find various applications; in particular, the material is most suitable for automobiles, railway vehicles and ships, where it will be used under sever conditions, and it is also suitable for household articles and beds.

What is claimed is:

1. A process for producing a structured fiber material, comprising the steps of:

blending non-elastic crimped short fibers (A) with heat-bonding composite fibers (B') exhibiting no three-dimensional crimps based on their own potential crimpability, said composite fibers (B') comprising a non-elastic polymer and a thermoplastic elastomer having a melting point that is at least 40° C. lower than the melting point of a polymer constituting said non-elastic crimped short fibers (A), at least part of said thermoplastic elastomer being exposed to an outer periphery of the cross-section of said composite fiber (B');

opening said blended fibers (A) and (B') to form opened fibers having three-dimensional fiber contact points between said heat-bonding composite fibers (B') as well as between said heat-bonding composite fibers (B') and said non-elastic crimped short fibers (A);

heat-treating said opened fibers at a temperature that is at least 10° C. higher than the melting point of said thermoplastic elastomer contained in said composite fibers (B') as a heat-bonding component, so that the potential crimpability of said heat-bonding composite fibers (B') is developed as the three-dimensional crimps, whereby said composite fibers (B') are formed into three-dimensionally crimped composite fibers (B) partially interlocked with other three-dimensionally and crimped composite fibers having coiled-spring shaped portions coiled around said non-elastic crimped short fiber (A); and heat-bonding at least part of said fiber contact points to form a structured fiber material comprising said non-elastic crimped short fibers (A) and three-dimensionally crimped short fibers (B), said fibers (B) being partially interlocked with each other, in which contact portions said fibers (B) are partially heat-bonded with each other, at least a portion of said fibers (B) being wound around said fibers (A) at their contact points, in which contact portions said fibers (A) and (B) are partially heat-bonded with each other.

2. A process according to claim 1, wherein said thermoplastic elastomer of said heat-bonding composite fibers (B') contains an anti-oxidant in an amount of 1% to 5% by weight, based on the total weight of said elastomer.

3. A process according to claim 1, wherein said anti-oxidant is selected from hindered phenol compounds and hindered amine compounds.

4. A process according to claim 1, wherein the weight ratio of said thermoplastic elastomer to said non-elastic polymer in said heat-bonding composite fibers (B') is in the range of from 20/80 to 70/30.

5. A process according to claim 1, wherein said heat-bonding composite fiber (B') has an eccentric sheath-core structure.

6. A process according to claim 1, wherein the content of said heat-bonding composite fibers (B') is in the range of from 10% to 70% by weight, based on the total weight of said material.

7. A process according to claim 1, wherein the content of said heat-bonding composite fibers (B') is in the range of from 20% to 50% by weight, based on the total weight of said material.

8. A process according to claim 1, wherein said non-elastic crimped short fiber (A) is a polyester fiber.

9. A process according to claim 8, wherein said non-elastic crimped short fiber (A) has an initial tensile strength of 30 g/denier or more.

10. A process according to claim 8, wherein said non-elastic crimped short fiber (A) has an initial tensile strength of 40 g/denier or more.

11. A process for producing a structured fiber material, comprising the steps of:

blending non-elastic crimped short fibers (A) with heat-bonding composite fibers (B') exhibiting no three-dimensional crimps based On their own potential crimpability, said heat-bonding composite fiber (B') being composed of a thermoplastic elastomer (C) having a melting point that is at least 40° C. lower than the melting point of a polymer constituting said non-elastic crimped short fibers (A) and a thermoplastic elastomer (D) having a melting point that is at least 30° C. higher than the melting point of said thermoplastic elastomer (C), at least half of said thermoplastic elastomer (C) being exposed to the surface of said composite fiber (B');

opening said blended fibers (A) and (B') to form opened fibers having three-dimensional fiber contact points between said heat-bonding composite fibers (B') as well as between said heat-bonding composite fibers (B') and said non-elastic crimped short fibers (A);

heat-treating said opened fibers at a temperature that is at least 10° C. higher than the melting point of said thermoplastic elastomer (C) contained in said composite fibers (B') as a heat-bonding component, so that the potential crimpability of said heat-bonding composite fibers (B') is developed as the three-dimensional crimps, whereby said composite fibers (B') are formed into three-dimensionally crimped composite fibers (B) partially interlocked with other three-dimensionally crimped composition fibers (B) and having coiled-spring shaped portions coiled around said non-elastic crimped short fibers (A); and heat-bonding at least part of said fiber contact points to form a structured fiber material comprising said non-elastic crimped short fibers (A) and three-dimensionally crimped short fibers (B), said fibers (B) being partially interlocked with each other, in which contact portions said fibers (B) are partially heat-bonded with each other, at least a portion of said fibers (B) being wound around said fibers (A) at their contact points, in which contact portions said fibers (A) and (B) are partially heat-bonded with each other.

12. A process according to claim 11, wherein said thermoplastic elastomer (C) of said heat-bonding composite fibers (B') contains an anti-oxidant in an amount of 1% to 5% by weight, based on the total weight of said elastomer.

13. A process according to claim 11, wherein said anti-oxidant is selected from hindered phenol compounds and hindered amine compounds.

14. A process according to claim 11, wherein the weight ratio of said thermo-plastic elastomer (C) to said thermo-plastic elastomer (D) in said composite fibers (B') is in the range of from 20/80 to 70/30.

15. A process according to claim 11, wherein said heat-bonding composite fiber (B') has an eccentric sheath-core structure.

16. A process according to claim 11, wherein the content of said heat-bonding composite fibers (B') is in the range of from 10% to 70% by weight, based on the total weight of said material.

17. A process according to claim 11, wherein the content of said heat-bonding composite fibers (B') is in the range of from 20% to 50% by weight, based on the total weight of said material.

18. A process according to claim 11, wherein said non-elastic crimped short fiber (A) is a polyester fiber.

19. A process according to claim 18, wherein said non-elastic crimped short fiber (A) has an initial tensile strength of 30 g/denier or more.

20. A process according to claim 18, wherein said non-elastic crimped short fiber (A) has an initial tensile strength of 40 g/denier or more.

* * * * *